United States Patent [19]

Raczkowski

[11] 4,042,985

[45] Aug. 23, 1977

[54] AUTOMATIC BED MAKING DEVICE

[76] Inventor: Mark B. Raczkowski, 55c Bruan Place, Clifton, N.J. 07012

[21] Appl. No.: 631,628

[22] Filed: Nov. 13, 1975

[51] Int. Cl.[2] ..... A47C 21/02

[52] U.S. Cl. ..... 5/317 R; 297/221

[58] Field of Search ..... 5/317 R, 60; 297/221, 297/283; 108/91, 90

[56] References Cited

U.S. PATENT DOCUMENTS

| | | | |
|---|---|---|---|
| 805,805 | 4/1905 | Loose | 297/283 |
| 942,606 | 12/1909 | Wilson | 5/317 R |
| 1,273,953 | 7/1918 | Torano | 297/283 |
| 1,877,610 | 9/1932 | Steiner | 108/90 |
| 3,343,183 | 9/1967 | Sannes | 5/317 R |
| 3,388,406 | 6/1968 | Scrivener | 5/317 R |
| 3,641,600 | 2/1972 | Oats | 5/317 R |
| 3,810,263 | 5/1974 | Taylor et al. | 5/317 R |
| 3,946,450 | 3/1976 | Staggs | 5/317 R |

FOREIGN PATENT DOCUMENTS

| | | | |
|---|---|---|---|
| 2,119,025 | 10/1972 | Germany | 5/317 R |

*Primary Examiner*—Paul R. Gilliam
*Assistant Examiner*—Alex Grosz

[57] ABSTRACT

In an electrically or manually operated automatic bed making device, rollers are rotatably positioned at spaced opposite first and second ends of a mattress on a bed spring. A bed sheet and a bedspread are removably affixed to each other to form an endless loop and the loop is mounted on the rollers in a manner whereby part of the loop is on the upper surface of the mattress and part of the loop is beneath the bed spring. A pillow is removably affixed to the bed sheet. A blanket is removably affixed to the bed sheet. A motive device drivingly coupled to the rollers selectively rotates the rollers to selectively move the bedspread or the combined sheet, pillow and blanket onto the upper surface of the mattress and simultaneously move the combined sheet, pillow and blanket or the bedspread beneath the bed spring thereby selectively dressing the bed for non-use and preparing it for use.

2 Claims, 7 Drawing Figures

FIG. 3
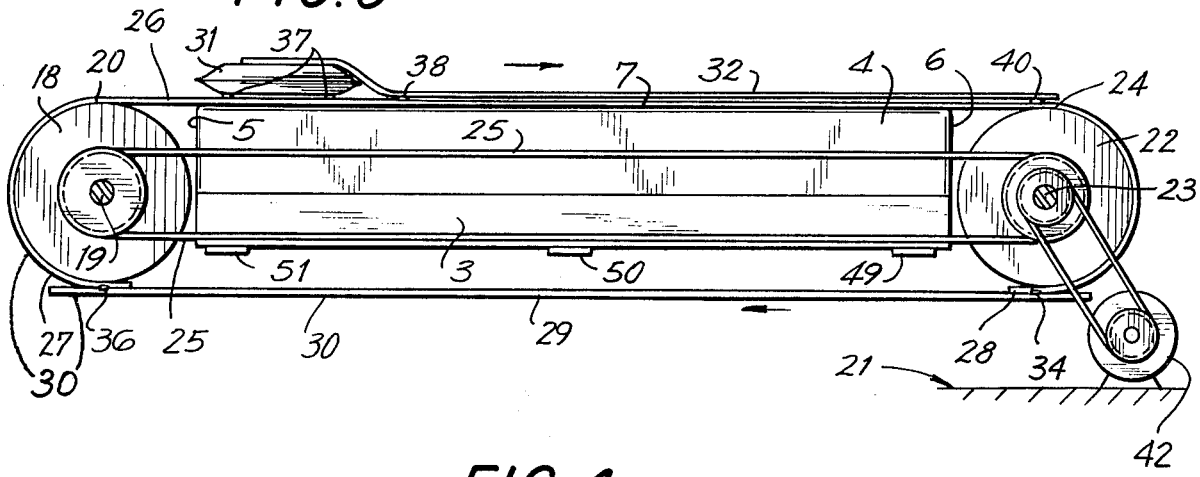
FIG. 4
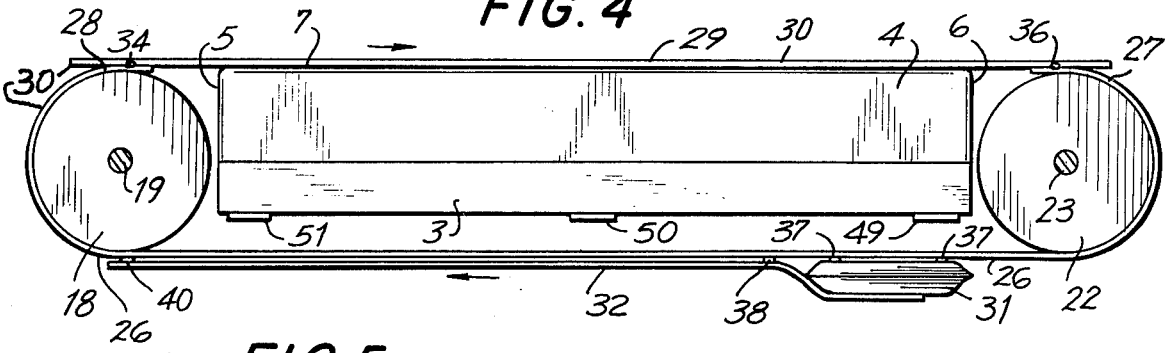
FIG. 5
FIG. 6
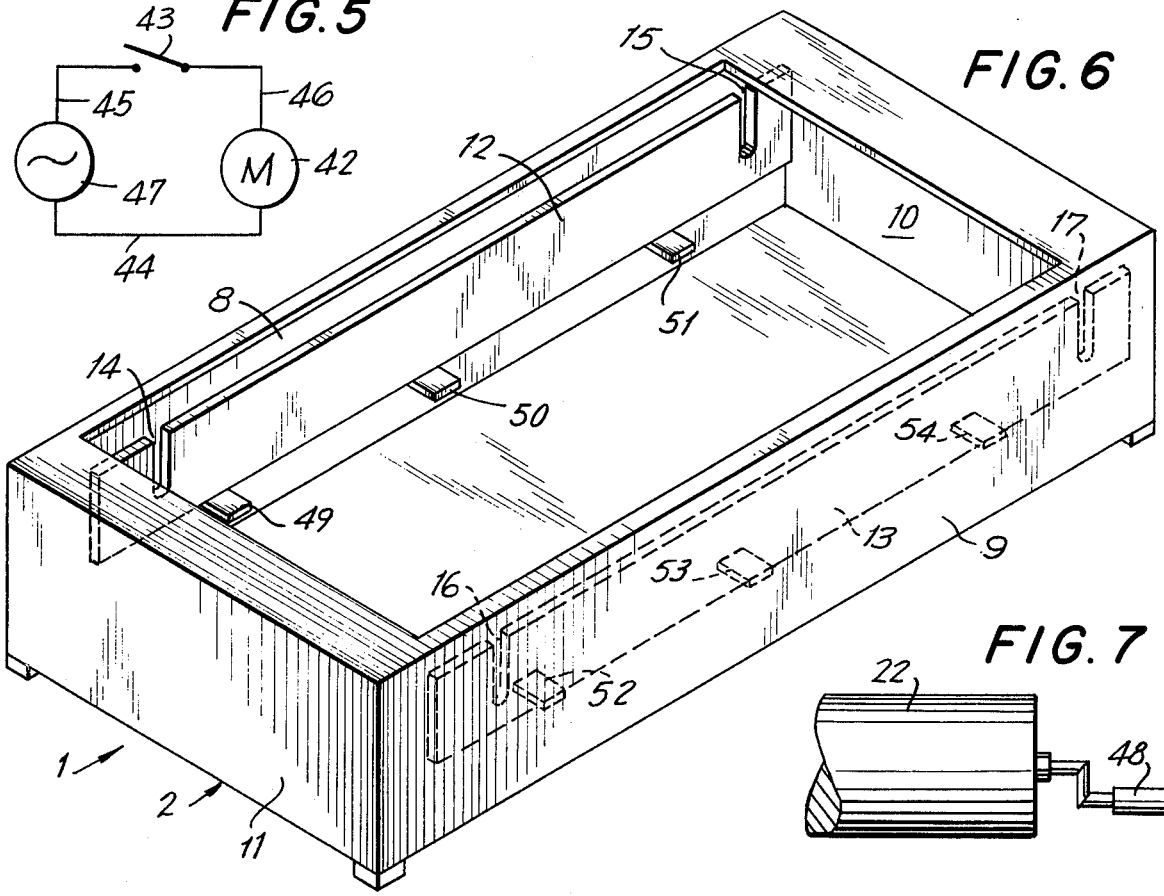
FIG. 7

AUTOMATIC BED MAKING DEVICE

BACKGROUND OF THE INVENTION

The present invention relates to a bed making device. More particularly, the invention relates to a bed making device for a bed having a mattress on a bed spring, the mattress having spaced opposite first and second ends and an upper surface, and a bed frame maintaining the mattress and bed spring in substantially horizontal positions.

The principle object of the invention is to provide a bed making device for automatically making a bed for selectively dressing it for non-use and preparing it for use.

An object of the invention is to provide a bed making device of simple structure, which is inexpensive in manufacture and functions to automatically selectively dress a bed for non-use and prepare it for use.

Another object of the invention is to provide a bed making device of simple structure, which is installed with facility and convenience and functions efficiently, effectively and reliably to selectively dress a bed for non-use an prepare it for use.

Still another object of the invention is to provide a bed making device of simple structure, which is used by anyone, without the need for skill of any kind, with facility, convenience and rapidity, and functions to automatically selectively dress a bed for non-use and prepare it for use.

BRIEF SUMMARY OF THE INVENTION

In accordance with the invention, a bed making device for a bed having a bed frame, a bed spring and a mattress on the bed spring, both the mattress and the bed spring having spaced opposite first and second ends, the mattress having an upper surface, and said bed spring and mattress being supported by the bed frame in substantially horizontal positions with the upper surface of the mattress substantially horizontal, comprises roller means rotatably mounted in the bed frame and positioned at the first and second ends of the mattress and with uppermost parts thereof substantially coplanar with the upper surface of the mattress. A bed sheet has spaced opposite first and second ends. A bedspread has spaced opposite first and second ends removably affixed to the first and second ends of the bed sheet to form an endless loop. The loop is mounted on the roller means in a manner whereby part of the loop is on the upper surface of the mattress and part of the loop is beneath the bed spring. A pillow is removably affixed to the bedsheet in the area of one of the ends thereof. A blanket is removably affixed to the bed sheet and covers most of the bed sheet. Motive means is drivingly coupled to the roller means for selectively rotating the roller means to selectively move one of the bedspread and the combined sheet, pillow and blanket onto the upper surface of the mattress and simultaneously move the other of the bedspread and the combined sheet, pillow and blanket beneath the bed spring thereby selectively dressing the bed for non-use and preparing it for use.

The bed frame has a pair of spaced parallel sides. The roller means comprises a first roller rotatably mounted on the sides of the bed frame at the first end of the mattress. The first roller has an axis substantially perpendicular to the sides and is positioned with part thereof a maximum distance above a bed frame supporting surface. The part is substantially coplanar with the upper surface of the mattress. A second roller is rotatably mounted on the sides of the bed frame at the second end of the mattress. The second roller is parallel to the first roller and substantially coplanar therewith. Coupling means couples the first and second rollers to each other for conjoint rotation about their axes. The loop is mounted on the rollers and extends therebetween.

The motive means comprises an electric motor drivingly coupled to one of the rollers for selectively rotating the rollers about their axes. Circuit means supplies electrical energy to the motor via switch means in a manner whereby the switch means controls the operation of the motor and thereby controls the rotation of the rollers to control the positioning of the selected one of the bedspread and the combined sheet, pillow and blanket in a desired position.

The motive means may comprise a crank handle connected to one of the rollers for manually selectively rotating the rollers about their axes.

BRIEF DESCRIPTION OF THE DRAWINGS

In order that the invention may be readily carried into effect, it will now be described with reference to the accompanying drawings, wherein:

FIG. 3 is a schematic diagram illustrating an embodiment of the motive device and the roller device of the bed making device of the invention, with the sheet, pillow and blanket in position on the upper surface of the mattress;

FIG. 4 is a schematic diagram illustrating the roller device of the bed making device of the invention, with the bedspread in position on the upper surface of the mattress;

FIG. 5 is a circuit diagram of the bed making device of the invention;

FIG. 6 is a perspective view of an embodiment of the bed frame of the bed making device of the invention; and FIG. 7 is a view of another embodiment of the motive device of the bed making device of the invention.

In the FIGS., the same components are identified by the same reference numerals.

Figures 1, 2:
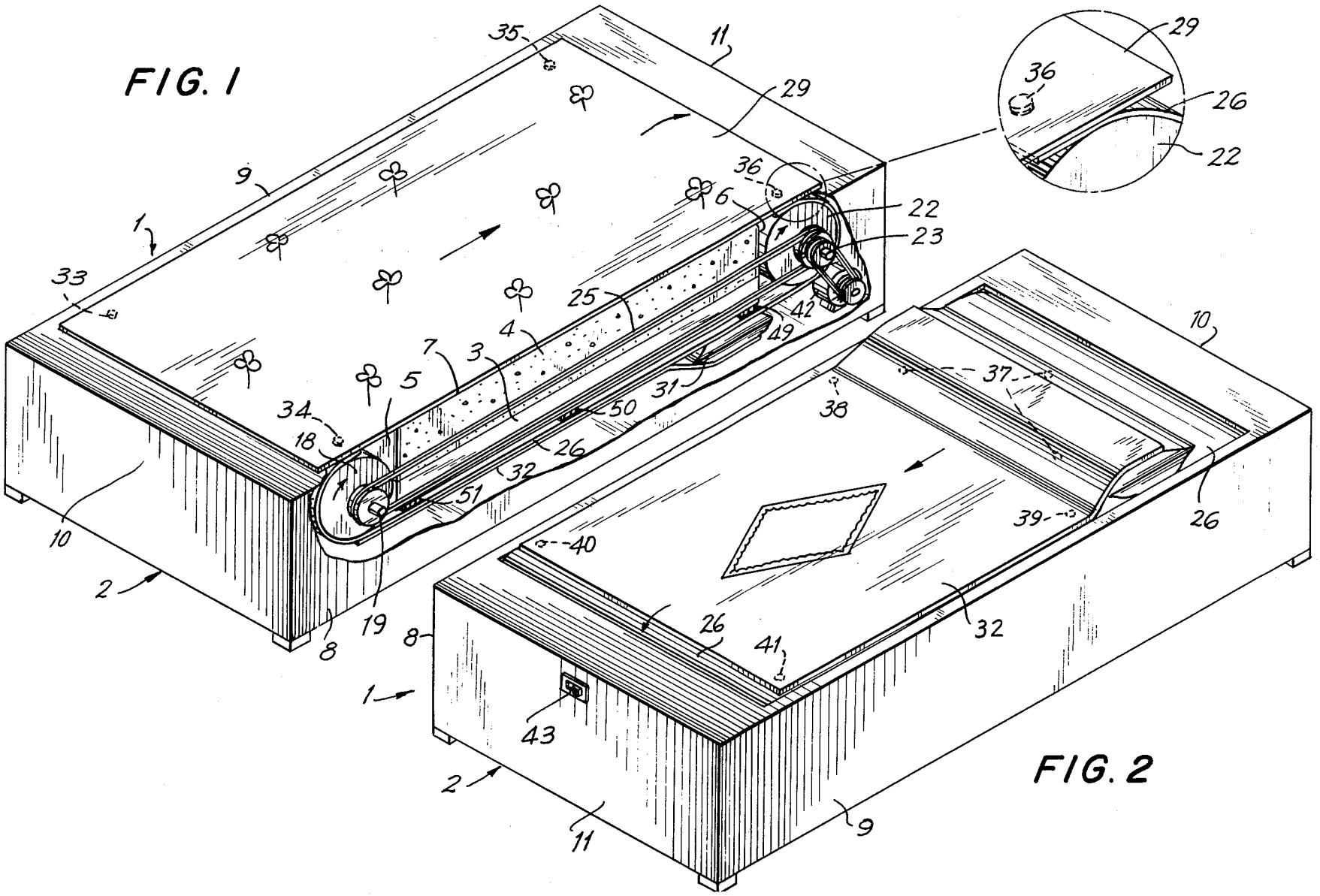
FIG. 1 is a cutaway perspective view of a bed incorporating the bed making device of the invention, showing the bedspread positioned on the upper surface of the mattress.
FIG. 2 is a perspective view of the bed of FIG. 1, showing the sheet, pillow and blanket positioned on the upper surface of the mattress.

DETAILED DESCRIPTION OF THE INVENTION:

The bed making device of the invention is for a bed 1 (FIGS. 1, 2 and 6) having a bed frame 2 (FIGS. 1, 2 and 6), a bed spring 3 (FIG. 1) and a mattress 4 (FIGS. 1 and 3) on the bed spring. Both the mattress 4 and the bed spring 3 have spaced opposite first and second ends 5 and 6, respectively, and the mattress has an upper surface 7 (FIGS. 1 and 3). The bed spring 3 and the mattress 4 are supported by the shelf supports 49, 50, 51, 52, 53 and 54 of the support members 12 and 13 of the bed frame 2 (FIG. 6) in substantially horizontal positions with the upper surface 7 of the mattress substantially horizontal (FIGS. 1 and 3).

The bed making device of the invention comprises a roller device rotatably mounted in the bed frame 2 and positioned at the first and second ends 5 and 6 of the mattress 4 and with uppermost parts thereof substantially coplanar with the upper surface 7 of the mattress. As shown in FIG. 6, the bed frame 2 has a pair of spaced parallel sides 8 and 9, a head end 10 and a foot end 11. The roller means comprises a pair of roller support members 12 and 13 affixed to the sides 8 and 9, respectively, of the bed frame 2, as shown in FIG. 6. The roller support members 12 and 13 have slots 14 and 15, and 16 and 17, respectively (FIG. 6) formed therein, and the shelf supports 49, 50, 51, 52, 53 and 54 (FIG. 6), as hereinbefore described.

A first roller 18 (FIGS. 1, 3 and 4) is rotatably mounted on the sides 8 and 9 of the bed frame via the slots 15 and 17 of the support members 12 and 13 at the first end 5 of the mattress 4 and has an axis 19 (FIGS. 1 and 3) substantially perpendicular to said sides. The first roller 18 is positioned with a part 20 thereof a maximum distance above a bed frame supporting surface 21 (FIG. 3). The part 20 of the first roller 18 is substantially coplanar with the upper surface 7 of the mattress 4, as shown in FIGS. 1 and 3.

The roller device further comprises a second roller 22 (FIGS. 1, 3 and 4) rotatably mounted on the sides 8 and 9 of the bed frame 2 via the slots 14 and 16 of the support members 12 and 13 at the second end 6 of the mattress 4, as shown in FIGS. 1 and 3. The second roller 22 is parallel to the first roller 18 and substantially coplanar therewith, so that the axis 23 (FIG. 3) of the said second roller is coplanar with the axis 19 of said first roller. A part 24 (FIG. 3) of the second roller 22 is positioned a maximum distance above the bed supporting surface 21 and is coplanar with the corresponding part 20 of the first roller 18.

The roller device further comprises a coupling device of any suitable type such as, for example, a drive belt 25 (FIG. 3), coupling the first and second rollers 18 and 22 to each other for conjoint rotation about their axes 19 and 23, respectively.

In accordance with the invention, a bed sheet 26 (FIGS. 1 to 4) has spaced opposite first and second ends 27 and 28, respectively, as shown in FIGS. 3 and 4.

A bedspread 29 (FIGS. 1, 3 and 4) has spaced opposite first and second ends coinciding with the first and second ends 27 and 28 of the sheet 26 and removably affixed to the first and second ends of said sheet to form an endless loop 30, as shown in FIGS. 3 and 4. The loop 30 is mounted on the first and second rollers 18 and 22 in a manner whereby part of the loop is on the upper surface 7 of the mattress 4, and part of the loop is beneath the bed spring 3, as shown in FIG. 3.

A pillow 31 (FIGS. 1 to 4) is removably affixed to the bed sheet 26 in the area of the first end 27 of said sheet.

A blanket 32 (FIGS. 1 to 4) is removably affixed to the bed sheet 26 and covers most of said bed sheet.

The bedspread 29 and the sheet 26 are affixed to each other in the same manner that the pillow 31 is affixed to said sheet and the blanket 32 is affixed to said sheet. Any suitable fastening device such as, for example, Velcro fasteners or snap fasteners, may be utilized to removably affix the bedspread and sheet to each other, the pillow to the sheet and the blanket to the sheet.

Some of the fasteners are shown in FIGS. 1 and 2. Thus, in FIG. 1, fasteners 33, 34, 35 and 36, of any suitable known type, removably fasten the bedspread 29 and the sheet 26 to each other. As shown in FIGS. 2 and 3, a fastener 37, of any suitable known type, affixes the pillow 31 to the sheet 26, fasteners 38, 39, 40 and 41, of any suitable known type, removably affix the blanket 32 to the sheet.

A motive device is drivingly coupled to the roller device for selectively rotating the rollers 18 and 22 to selectively move either the bedspread 29 or the combined sheet 26, pillow 31 and blanket 32 onto the upper surface 7 of the mattress 4 and simultaneously moves the other of said bedspread or said combined sheet, pillow and blanket beneath the bed spring 3 thereby selectively dressing the bed for non-use and preparing it for use, as shown in FIGS. 3 and 4.

The motive device comprises an electric motor 42 (FIGS. 1, 3 and 5) drivingly coupled to the second roller 22 for selectively rotating the rollers 18 and 22 about their axes 19 and 23, respectively. The motive device further comprises a manually operated switch 43 (FIGS. 2 and 5) which may comprise a pushbutton switch, as shown in FIG. 2. As shown in FIG. 5, a circuit 44, 45, 46 supplies electrical energy from any suitable source of electrical energy 47 such as, for example, a commercial power source of alternating current, to the motor 42 via the switch 43. The switch 43 controls the operation of the motor 42 and thereby controls the rotation of the rollers 18 and 22 to control the positioning of the bedspread 29 or the combined sheet 26, pillow 31 and blanket 32 in a desired position.

If a user wants to use the bed 1, he or she closes the switch 43 by depressing it. This energizes the motor 42, so that said motor rotates the rollers 18 and 22 until the combined sheet 26, pillow 31 and blanket 32 are moved onto the upper surface 7 of the mattress 4, as shown in FIGS. 2 and 3. At such time, the user releases or opens the switch 43, thereby deenergizing the motor 42 and causing the combined sheet 26, pillow 31 and blanket 32 to remain in position on the upper surface 7 of the mattress 4. Since any suitable type of switch 43 may be utilized, one type which may be utilized would permit the user to maintain pressure on the switch and thereby keep the motor 42 operating until such pressure is released. Another type of switch would permit the user to merely depress it to start the motor, leave it to operate, and then depress it again to stop the motor at a desired time.

When the user wishes to dress the bed for non-use, he or she closes the switch 43, thereby energizing the motor 42 to rotate the rollers 18 and 22 and thereby rotate the loop 30 until the bedspread 29 moves onto the upper surface 7 of the mattress 4, as shown in FIGS. 1 and 4. The user opens the switch 43 when the bedspread 29 is positioned over the mattress 4, thereby retaining said bedspread in position.

The bed making device of the invention thus permits a bed to be prepared for use and to be dressed for non-use, as desired, by the mere operation of a switch. The switch is placed at any convenient place such as, for example, shown in FIG. 2, at the foot of the bed 1. Since the bed clothes, including the sheet 26, pillow 31, blanket 32 and bedspread 29 are all removably affixed to form the loop 30, they may be readily operated individually, or severally, for laundering and replacement with freshly laundered items.

The motive device may comprise a crank handle 48 coupled to the second roller 22 for manually rotating said roller, as shown in FIG. 7. Thus, manual energy is used instead of electrical energy to operate the bed making device of the invention in the aforedescribed manner.

The bed making device of the invention may be readily built in miniature and mounted under a miniature bed of the same structure as described, but with considerably smaller dimensions, and thereby function as a toy. In such case, the source of electrical energy 47 may comprise any suitable type of battery or batteries, rechargeable, if desired.

While the invention has been described by means of specific examples and in specific embodiments, I do not wish to be limited thereto, for obvious modifications will occur to those skilled in the art without departing from the spirit and scope of the invention.

I claim:

1. A bed-making device for a bed having a bed frame supporting a mattress and bed spring, both the mattress and the bed springs having spaced opposite first and second ends, said mattress having an upper surface and said bed spring and mattress being supported by the bed frame in substantially horizonal positions, said bed-making device comprising:

a supporting structure affixed to the bed frame and positioned at the first and second ends of the mattress;

a first roller means rotatably mounted on the side of the supporting structure at the first end of the mattress, said first roller means having an axis substantially perpendicular to said supporting structure and being positioned with a part thereof, a maximum distance above a bed frame supporting structure, said part being substantially coplanar with the upper surface of the mattress and a second roller means rotatably mounted on the side of the supporting structure at the second end of the mattress, said second roller means being parallel to the first roller means and substantially coplanar therewith;

coupling means coupling the first and second roller means to each other for conjoint rotations about their axes;

a bed sheet having spaced opposite first and second ends;

a bed spread having spaced opposite first and second ends;

first fastener means affixed to the first end of the bed sheet and the second end of the bed spread, for affixing the first end of the bed sheet to the second end of the bed spread;

second fastener means affixed to the second end of the bed sheet and the first end of the bed spread, for affixing the second end of the bed sheet to the first end of the bed spread;

an endless loop formed by the bed sheet and bed spread affixed to each other by the first and second fastener means, being mounted on the roller means in a manner whereby part of said loop is on the upper surface of the mattress and part of said loop is beneath the bed springs;

a pillow removably affixed to the bed sheet in the area of one of the ends thereof;

a blanket removably affixed to the bed sheet and covering most of the said bed sheet;

motive means drivingly coupled to the roller means for selectively rotating said roller means to selectively move the bed sheet and the affixed pillow and blanket to the upper surface of the mattress and simultaneously move the bed spread beneath the bed springs thereby selectively dressing the bed for non-use and preparing it for use.

2. A bed making device as claimed in claim 1, wherein said motive means comprises and electric motor drivingly coupled to one of the roller means for selectively rotating said roller means about their axes, switch means and circuit means for supplying electrical energy to the motor via the switch means or a manner whereby said switch means controls the operation of said motor and thereby controls the relation of said roller means to control the positioning of the selected one of the bed spread, and the combined sheet, pillow and blanket in a desired position.

* * * * *